US005153043A

United States Patent [19]

Wang

[11] Patent Number: 5,153,043

[45] Date of Patent: Oct. 6, 1992

[54] LATERALLY TEARING TAPE STRIP

[75] Inventor: Chung C. Wang, Taipei, Taiwan

[73] Assignee: Seal King Industrial Co., Ltd., Taipei, Taiwan

[21] Appl. No.: 670,935

[22] Filed: Mar. 18, 1991

Related U.S. Application Data

[63] Continuation-in-part of Ser. No. 417,082, Oct. 4, 1989, abandoned.

[51] Int. Cl.[5] ..... B32B 3/10; B32B 7/06; B32B 7/12

[52] U.S. Cl. ..... 428/42; 428/192; 428/194; 428/201; 428/202; 428/203; 428/906; 428/41; 206/820; 206/813

[58] Field of Search ..... 428/41, 42, 192, 194, 428/201, 203, 906, 202; 206/411, 820, 813

[56] References Cited

U.S. PATENT DOCUMENTS

| | | | |
|---|---|---|---|
| 2,170,147 | 8/1939 | Lane | 428/906 |
| 2,303,144 | 11/1942 | Stephenson | 428/43 |
| 2,508,855 | 5/1950 | Brown | 428/43 |
| 2,764,501 | 9/1956 | Perri | 428/906 |
| 4,188,250 | 2/1980 | Grass | 428/42 |
| 4,457,539 | 7/1984 | Hamisch | 428/42 |

*Primary Examiner*—Alexander S. Thomas
*Attorney, Agent, or Firm*—Fleit, Jacobson, Cohn, Price, Holman & Stern

[57] ABSTRACT

A laterally tearing tape strip torn from a roll having a longitudinal axis. The tape is originally annularly rolled onto the roll. Several cuts extending parallel with the longitudinal axis of the roll extend radially through the tape to divide the tape into a plurality of laterally tearing tape strips. A portion of the tape and therefore each tape strip does not include adhesive over a defined area which serves as a leading edge for each strip, a remaining portion of which does not include adhesive, to facilitate removal of a laterally tearing tape strip from the roll.

5 Claims, 2 Drawing Sheets

LATERALLY TEARING TAPE STRIP

This application is a continuation-in-part application of application Ser. No. 07/417,082, filed Oct. 4, 1989 abandoned.

FIELD OF THE INVENTION

The present invention relates to a laterally tearing tape strip which is torn horizontally from a roll of tape which is formed from a regular size roll of tape film.

BACKGROUND OF THE INVENTION

Previously, tape has always been manufactured as a continuous roll. During use, a leading end of the tape is cut by a knife, a sharp edge or a pair of scissors. By such usage, a glued portion of the tape is gripped by the fingers of the operator and it is therefore dirtied as well as deglued. Moreover, it is often difficult to find the original end of the tape strip which is often reattached to the roll after a portion of tape has been removed. Prior practice for the use of tape has made it difficult to obtain successive pieces of tape cut to a constant size for repeated use for a similar job.

SUMMARY OF THE INVENTION

It is therefore a primary object of the present invention to overcome the aforesaid disadvantages.

A secondary object of the present invention is to provide a laterally tearing tape strip which can be used without having the glued portion touched by the fingers of the operator.

A further object of the present invention is to provide a constant and standardized tape length which is manufactured in a desired length and width.

A still further object of the present invention is to provide a single laterally tearing tape strip removed from a roll of tape in which the strips have a constant length with a non-glued leading portion for ease of removal from the roll of tape.

Another object of the present invention is to provide a laterally tearing tape strip which is only partially glued for ease of separation from a roll of tape having a tapered or sloping edge on the roll so as to expose a non-glued portion of the tape for ease of removal from the roll.

These and other objects of the present invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
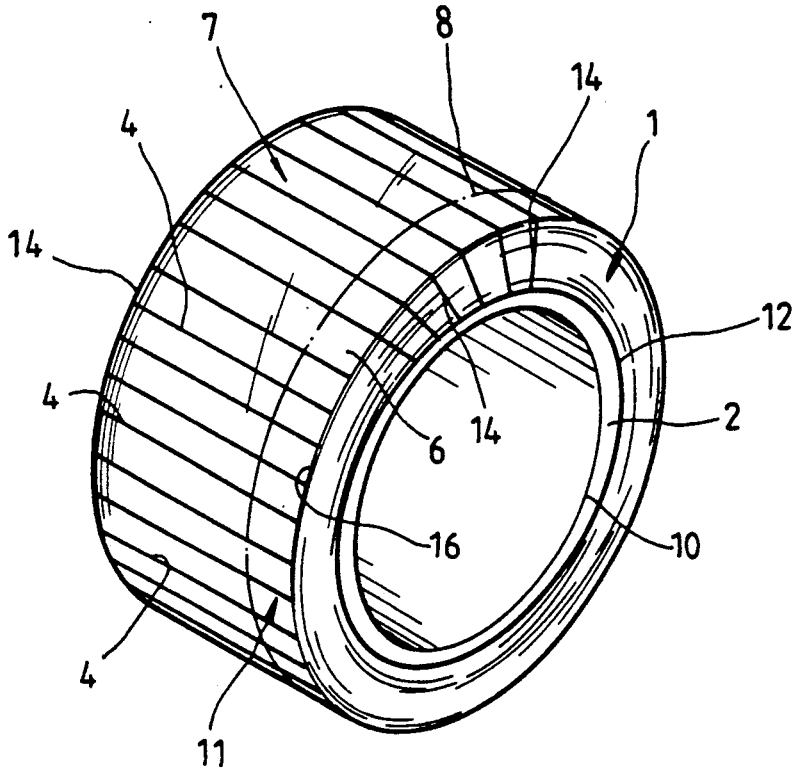
FIG. 1 is a perspective view of a roll of laterally tearing tape strips.
Figure 2:
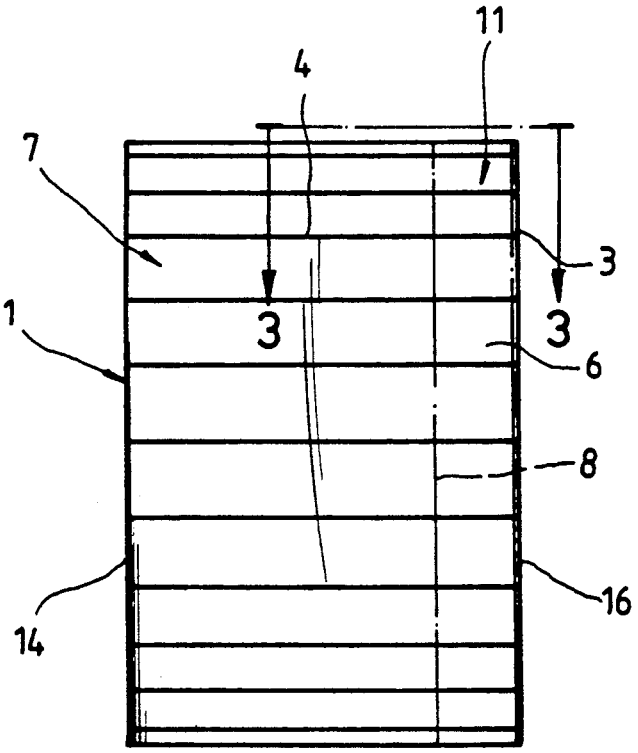
FIG. 2 is a side view of the tape.
Figure 3:
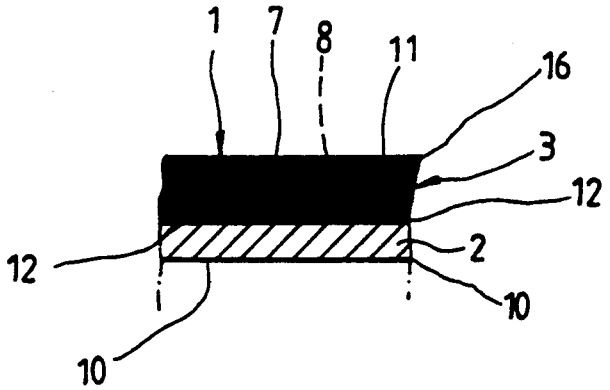
FIG. 3 is an enlarged cross-sectional view taken along line 3—3 of FIG. 2.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

FIG. 1 is a perspective view of a roll of laterally tearing tape strips of the present invention. A single sheet of tape film 1 is continuously wound around a central core 2 by a coning process. The tape film includes an adhesive backed portion and a non-adhesive backed portion. The core has a radially inner edge 10 and a radially outer edge 12 and is made of a section of tubular cardboard.

The tape film 1 wound on the core 2 is divided into a plurality of strips 6, each strip having two portions which integrally form a single strip. The two portions are divided by an imaginary line represented by dotted line 8. The major portion 7 extending from edge 14 of the tape film 1 to the imaginary dotted line 8 includes an adhesive backing for sticking of individual tape strips to a surface. The remaining, minor portion 11 extending from edge 16 of tape film 1 to the imaginary dotted line 8 does not include an adhesive backing and will serve as a leading portion for gripping and pulling strip of tape from the roll. The tape strip will be held at the minor portion 11 when being removed from the roll and will not stick to the fingers of the operator. Each layer of tape film forms circumferentially contiguous elongate strips 6 extending axially with respect to the core 2 for tearing individually from the core 2 in an axial direction from one end of each strip.

Extending parallel to the longitudinal axis of the core 2, at a predetermined spacing are a plurality of cut lines 4 which extend radially inwardly from a peripheral surface of the wound tape film 1 to the core 2 and through all of the windings of the tape film and along edge 14 as well as along edge 16 of the tape film 1. In FIG. 1, six cut lines 4 have been shown along edge 16 of the tape film 1 for purposes of illustration. It is understood that for each cut line 4 shown in FIG. 1 at the radially outermost surface of the tape film 1 there is a corresponding radially inwardly extending cut line extending along edges 14 and 16.

The cut lines 4 form the respective width of a stack of strips 6 formed by the major portion 7 and minor portion 11. The strips are formed between every set of two adjacent cut lines 4 and one end thereof is connected together to form side edge 3 extending from edge 16 to edge 10. Side edge 3 tapers axially inwardly from a radially outermost peripheral surface of tape film 1, at edge 16, to core 2, at its radially outermost edge 12. The axial inward tapering of edge 3 provides a surface along which a finger may be slid in a radially outward and axially outward direction to fan out the stacked portions 11 of stacked tape strips 6. The radially outermost tape strip may then be lifted by portion 11 and separated laterally from the roll so as to stick portion 7 on an object to be taped. The contiguous strips 6 of tape are aligned at least at one end 3 to provide a continuous unified edge which tapers axially inwardly.

The width of a tape strip is predetermined for any needed requirement and the cut lines 4 could also be made in the form of a curve or zig-zag, etc. In appearance the adhesive backed portions 7 appear transparent so that the core 2 can be seen from the exterior of the roll, looking through the portions 7. However, the portions 11 appear to be reflective and silvery in appearance due to an air spacing included between adjacent stacked portions 11.

Accordingly, it can be seen that the present invention provides many advantages and improvements. A tape roll provides a relatively constant length (excluding a slight variation in length from a radially outermost strip versus a radially innermost strip in the same stack due to the taper of side 3) of films for regular use. Since one end of the tape is without adhesive, the use of the tape is easier and better than previous tap strips. The present invention provides a new and improved product and is easy to work with.

Having described the invention, many modifications thereto will become apparent to those skilled in the art to which it pertains without deviation from the spirit of the invention as defined by the scope of the appended claims.

I claim:

1. An adhesive tape assembly comprising a cylindrical core and multiple layers of adhesive tape on the core, each layer comprising circumferentially contiguous elongate strips of tape extending axially with respect to the core for tearing individually from the core in an axial direction from one end of each strip, a first portion of each strip extending from said one end being free of adhesive and a second larger portion of each strip extending from said first portion substantially continuously to an opposite end of the strip and having an adhesive backing, the strips being separable from one another along continuous lines extending axially with respect to the core, and a leading edge of each first portion of each strip being stacked and tapering in an axially inward direction.

2. An adhesive tape as claimed in claim 1, wherein the contiguous strips are aligned at least at one end thereof to provide a continuous unified edge of the tape.

3. An adhesive tape assembly comprising:

a core member, a plurality of stacks of superimposed tape strips, each tape strip being adhesively secured to a preceding tape strip of a respective stack, and each stack emanating radially from said core member, each tape strip including a first portion being free of adhesive and a second portion including adhesive, and each tape strip being peelable from an underlying tape strip of a same stack by grasping said respective first portion of one tape strip and forcibly overcoming an adhesive force of said second portion of said one tape strip on a preceding tape strip of its stack.

4. An adhesive tape assembly according to claim 3, wherein each stack of superimposed tape strips include a longitudinal axis aligned parallel to a central axis of said core member.

5. An adhesive tape assembly according to claim 4, wherein said first portion of each tape strip is located along an edge of said core member.

* * * * *